US012332004B2

(12) United States Patent
Ho

(10) Patent No.: US 12,332,004 B2
(45) Date of Patent: Jun. 17, 2025

(54) HEAT EXCHANGE DEVICE AND HEAT EXCHANGE SYSTEM HAVING THE SAME

(71) Applicant: EVERINN INTERNATIONAL CO., LTD., Taichung (TW)

(72) Inventor: Yu-Pei Ho, Taichung (TW)

(73) Assignee: EVERINN INTERNAITONAL CO., LTD., Taichung (TW)

( * ) Notice: Subject to any disclaimer, the term of this patent is extended or adjusted under 35 U.S.C. 154(b) by 518 days.

(21) Appl. No.: 17/885,817

(22) Filed: Aug. 11, 2022

(65) Prior Publication Data

US 2023/0288151 A1 Sep. 14, 2023

(30) Foreign Application Priority Data

Mar. 14, 2022 (TW) ..... 111109259

(51) Int. Cl.
*F28F 9/02* (2006.01)
*F04D 29/58* (2006.01)

(52) U.S. Cl.
CPC ..... *F28F 9/02* (2013.01); *F04D 29/58* (2013.01); *F28F 2009/0292* (2013.01); *F28F 2220/00* (2013.01)

(58) Field of Classification Search
CPC .. F28F 9/02; F28F 2009/0292; F28F 2220/00; F04D 29/58
See application file for complete search history.

(56) References Cited

U.S. PATENT DOCUMENTS

| | | | | | |
|---|---|---|---|---|---|
| 3,854,528 | A * | 12/1974 | Pouderoux | F28D 7/1607 | 165/158 |
| 4,295,521 | A * | 10/1981 | Sommars | F01P 11/12 | 165/69 |
| 4,318,441 | A * | 3/1982 | Belleli | F28F 9/02 | 165/81 |
| 9,409,189 | B2 * | 8/2016 | Ho | B01D 45/08 | |
| 9,890,692 | B1 * | 2/2018 | Turnage | F28F 21/02 | |
| 11,035,620 | B1 * | 6/2021 | Trent | F28D 1/0477 | |
| 2008/0223561 | A1 * | 9/2008 | Li | F28F 27/02 | 165/156 |
| 2010/0163213 | A1 * | 7/2010 | Xu | H01L 23/467 | 165/104.26 |
| 2015/0273484 | A1 * | 10/2015 | Ho | B01D 45/08 | 55/321 |
| 2019/0358653 | A1 * | 11/2019 | Ho | B04C 9/00 | |
| 2021/0099046 | A1 * | 4/2021 | Ma | F03D 80/82 | |
| 2023/0288150 | A1 * | 9/2023 | Ho | F04D 29/58 | |
| 2023/0288151 | A1 * | 9/2023 | Ho | F28D 7/0066 | |

FOREIGN PATENT DOCUMENTS

TW I454650 10/2014

* cited by examiner

*Primary Examiner* — Raheena R Malik
(74) *Attorney, Agent, or Firm* — Burris Law, PLLC

(57) ABSTRACT

A heat exchange device includes two end caps each having two openings, a barrel connected to and disposed between the end caps, a heat exchanger disposed in the barrel, a condensing unit and an electric unit mounted respectively to the end caps. The heat exchanger includes two conduit members spaced apart by a gap, a passage unit and a vortex chamber. The condensing unit absorbing and dissipating heat of the fluid. The electric unit is co-movable with at least a portion of one of the conduit members such that a dimension of the gap is adjusted, so as to change the temperature of the fluid flowing out of the device.

11 Claims, 11 Drawing Sheets

HEAT EXCHANGE DEVICE AND HEAT EXCHANGE SYSTEM HAVING THE SAME

CROSS-REFERENCE TO RELATED APPLICATION

This application claims priority of Taiwanese Invention Patent Application No. 111109259, filed on Mar. 14, 2022.

FIELD

The disclosure relates to a cooling device, and more particularly to a heat exchange device and a heat exchange system having the same.

BACKGROUND

Referring to FIG. 1, a conventional heat exchange device 1 disclosed in Taiwanese Patent No. 1454650 includes a barrel 11, two end caps 12 detachably connected to the barrel 11, and a guiding tube member 13 mounted between the barrel 11 and one of the end caps 12. Each of the end caps 12 includes an inlet 121 and an outlet 122.

High temperature gas is introduced into the barrel 11 through the inlet 121 of one of the end caps 12, and flows out of the barrel 11 through the outlet 122 of the other one of the end caps 12. Similarly, low temperature gas is introduced into the barrel 11 through the inlet 121 of the other one of the end caps 12, and flows out of the barrel 11 through the outlet 122 of the one of the end caps 12. The high temperature gas mixes with the low temperature gas in the barrel 11 at an area near an open end 131 of the guiding tube member 13 so that the temperature of the high temperature gas flowing out of the outlets 122 is reduced.

Although the high temperature gas can be cooled down after being mixed with the low temperature gas, the degree of temperature reduction still depends on the amount of the low temperature gas introduced into the heat exchanger 1 and cannot be controlled since a dimension of the open end 131 is not adjustable.

SUMMARY

Therefore, an object of the disclosure is to provide a heat exchange device and a heat exchange system capable of alleviating at least the drawback of the conventional heat exchanger.

According to an aspect of the disclosure, a heat exchange device includes a barrel, a cap unit, a heat exchanger, an annular vortex generating member, a condensing unit and an electric unit. The barrel includes two end portions opposite along an axis. The cap unit includes two end caps detachably and respectively connected to the end portions. Each of the end caps has two openings spaced apart from each other. The heat exchanger is disposed in the barrel and between the end caps, and includes two conduit members spaced apart from each other along the axis by a gap. Each of the conduit members includes a surrounding wall that extends along the axis and that defines a passage therein, and a plurality of fins that extend radially from the surrounding wall. The heat exchanger cooperates with the barrel to define a vortex chamber therebetween. The passages of the conduit members cooperate with one of the openings of each of the end caps to define a first flow channel adapted to permit fluid to flow therethrough. The vortex chamber cooperates with the other one of the openings of each of the end caps to define a second flow channel adapted to permit fluid to flow therethrough. The fins are adapted to conduct heat exchange with the fluid flowing through the first flow channel and the second flow channel. The annular vortex generating member surrounds the axis, is mounted between the barrel and the heat exchanger, and includes a plurality of blades that are formed at an outer surface thereof and that are adapted to guide the fluid in the second flow channel to generate a vortex. The condensing unit is mounted to one of the end caps of the cap unit and includes a cooling chip module. The cooling chip module includes a heat absorbing plate disposed at an end of the cooling chip module proximate to the one of the end caps and adapted for absorbing heat of the fluid, and a heat dissipating plate disposed at an end of the cooling chip module distal from the one of the end caps along the axis and adapted to dissipate heat absorbed by the heat absorbing plate. The electric unit is mounted to the other one of the end caps of the cap unit and includes a motor, an internal threaded sleeve that is driven by the motor to rotate, and an external threaded shaft that threadedly engages and is driven by the internal threaded sleeve to move along the axis when the internal threaded sleeve is rotated, and that is co-movable with at least a portion of one of the conduit members such that the portion of the one of the conduit members is movable relative to the other one of the conduit members along the axis to adjust a dimension of the gap along the axis.

According to another aspect of the present disclosure, a heat exchange system includes a plurality of heat exchange devices and a connecting device. Each of the heat exchange devices includes a barrel, a cap unit, a heat exchanger, an annular vortex generating member, a condensing unit, and an electric unit. The barrel includes two end portions opposite along an axis. The cap unit includes two end caps detachably and respectively connected to the end portions. Each of the end caps has two openings spaced apart from each other. The heat exchanger is disposed in the barrel and between the end caps, and includes two conduit members spaced apart from each other along the axis by a gap. Each of the conduit members includes a surrounding wall that extends along the axis and that defines a passage therein, and a plurality of fins that extend radially from the surrounding wall. The heat exchanger cooperates with the barrel to define a vortex chamber therebetween. The passages of the conduit members cooperate with one of the openings of each of the end caps to define a first flow channel adapted to permit fluid to flow therethrough. The vortex chamber cooperates with the other one of the openings of each of the end caps to define a second flow channel adapted to permit fluid to flow therethrough. The fins are adapted to conduct heat exchange with the fluid flowing through the first flow channel and the second flow channel. The annular vortex generating member surrounds the axis, is mounted between the barrel and the heat exchanger, and includes a plurality of blades that are formed at an outer surface thereof and that are adapted to guide the fluid in the second flow channel to generate a vortex. The condensing unit is mounted to one of the end caps of the cap unit and includes a cooling chip module. The cooling chip module includes a heat absorbing plate disposed at an end of the cooling chip module proximate to the one of the end caps and adapted for absorbing heat of the fluid, and a heat dissipating plate disposed at an end of the cooling chip module distal from the one of the end caps along the axis and adapted to dissipate heat absorbed by the heat absorbing plate. The electric unit is mounted to the other one of the end caps of the cap unit and includes a motor, an internal threaded sleeve that is driven by the motor to rotate, and an external threaded shaft that threadedly engages and is driven by the internal threaded sleeve to move along the axis when the internal threaded sleeve is rotated, and that is co-movable with at least a portion of one of the conduit members such that the portion of the one of the conduit members is movable relative to the other one of the conduit members along the axis to adjust a dimension of the gap along the axis. The connecting device includes a plurality of connecting sets. Each of the connecting sets is detachably connected to adjacent two of the heat exchange devices.

According to still another aspect of the present disclosure, a heat exchange system includes at least one heat exchange device, at least one filtration device and a connecting device. The heat exchange device includes a barrel, a cap unit, a heat exchanger, an annular vortex generating member, a condensing unit, and an electric unit. The barrel includes two end portions opposite along an axis. The cap unit includes two end caps detachably and respectively connected to the end portions. Each of the end caps has two openings spaced apart from each other. The heat exchanger is disposed in the barrel and between the end caps, and includes two conduit members spaced apart from each other along the axis by a gap. Each of the conduit members includes a surrounding wall that extends along the axis and that defines a passage therein, and a plurality of fins that extend radially from the surrounding wall. The heat exchanger cooperates with the barrel to define a vortex chamber therebetween. The passages of the conduit members cooperate with one of the openings of each of the end caps to define a first flow channel adapted to permit fluid to flow therethrough. The vortex chamber cooperates with the other one of the openings of each of the end caps to define a second flow channel adapted to permit fluid to flow therethrough. The fins are adapted to conduct heat exchange with the fluid flowing through the first flow channel and the second flow channel. The annular vortex generating member surrounds the axis, is mounted between the barrel and the heat exchanger, and includes a plurality of blades that are formed at an outer surface thereof and that are adapted to guide the fluid in the second flow channel to generate a vortex. The condensing unit is mounted to one of the end caps of the cap unit and includes a cooling chip module. The cooling chip module includes a heat absorbing plate disposed at an end of the cooling chip module proximate to the one of the end caps and adapted for absorbing heat of the fluid, and a heat dissipating plate disposed at an end of the cooling chip module distal from the one of the end caps along the axis and adapted to dissipate heat absorbed by the heat absorbing plate. The electric unit is mounted to the other one of the end caps of the cap unit and includes a motor, an internal threaded sleeve that is driven by the motor to rotate, and an external threaded shaft that threadedly engages and is driven by the internal threaded sleeve to move along the axis when the internal threaded sleeve is rotated, and that is co-movable with at least a portion of one of the conduit members such that the portion of the one of the conduit members is movable relative to the other one of the conduit members along the axis to adjust a dimension of the gap along the axis. The filtration device is connected to and in fluid communication with the heat exchange device and is adapted to filter the fluid passing therethrough to capture moisture, oil mist, dust, particles, and a combination thereof in the fluid; and a connecting device including at least one connecting set detachably connected between the at least one heat exchange device and the at least one filtration device.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
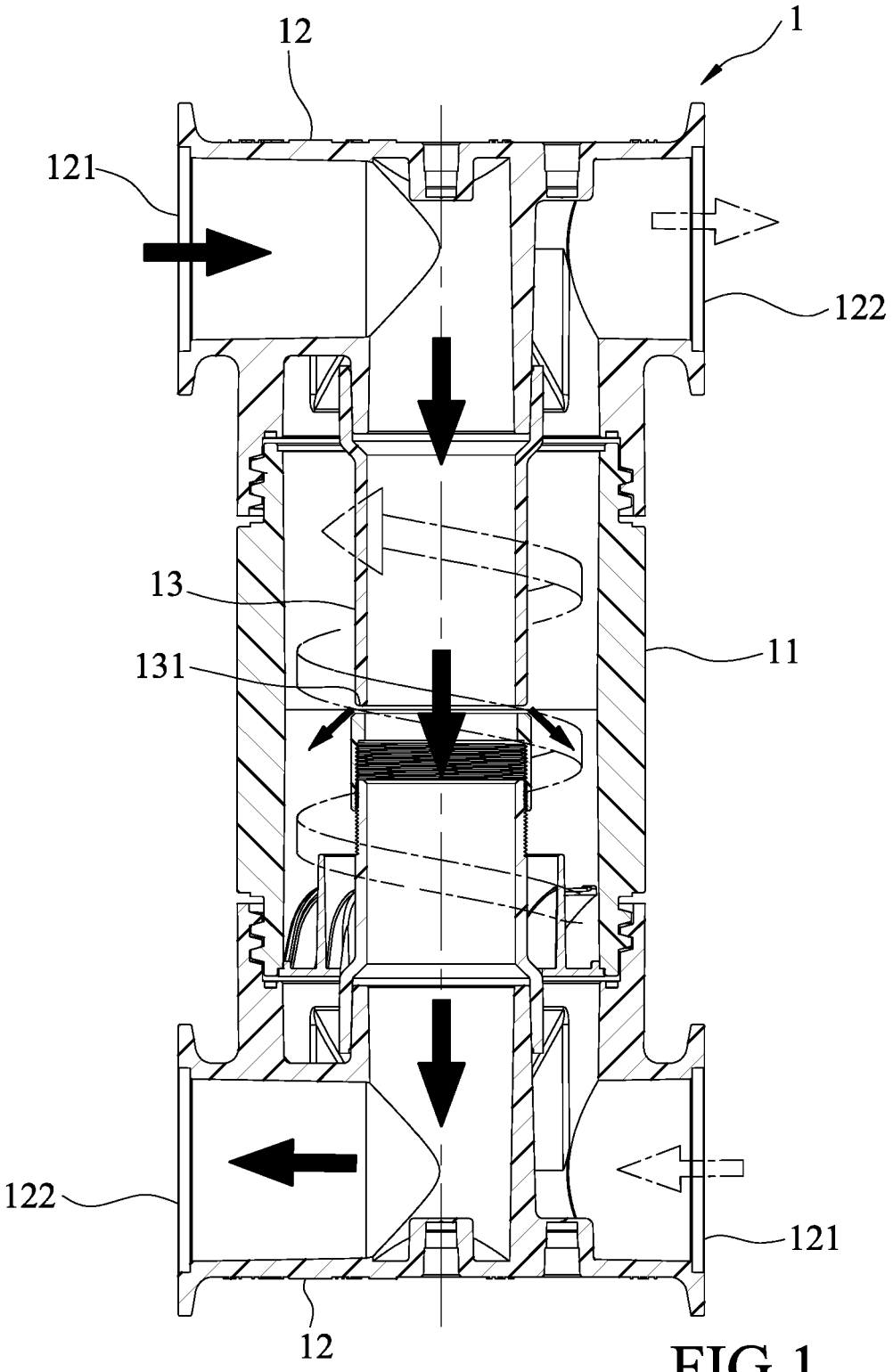
FIG.1 PRIOR ART
FIG. 1 is a schematic sectional view of a conventional heat exchange device disclosed in Taiwanese Patent No. 1454650.
Figure 2:
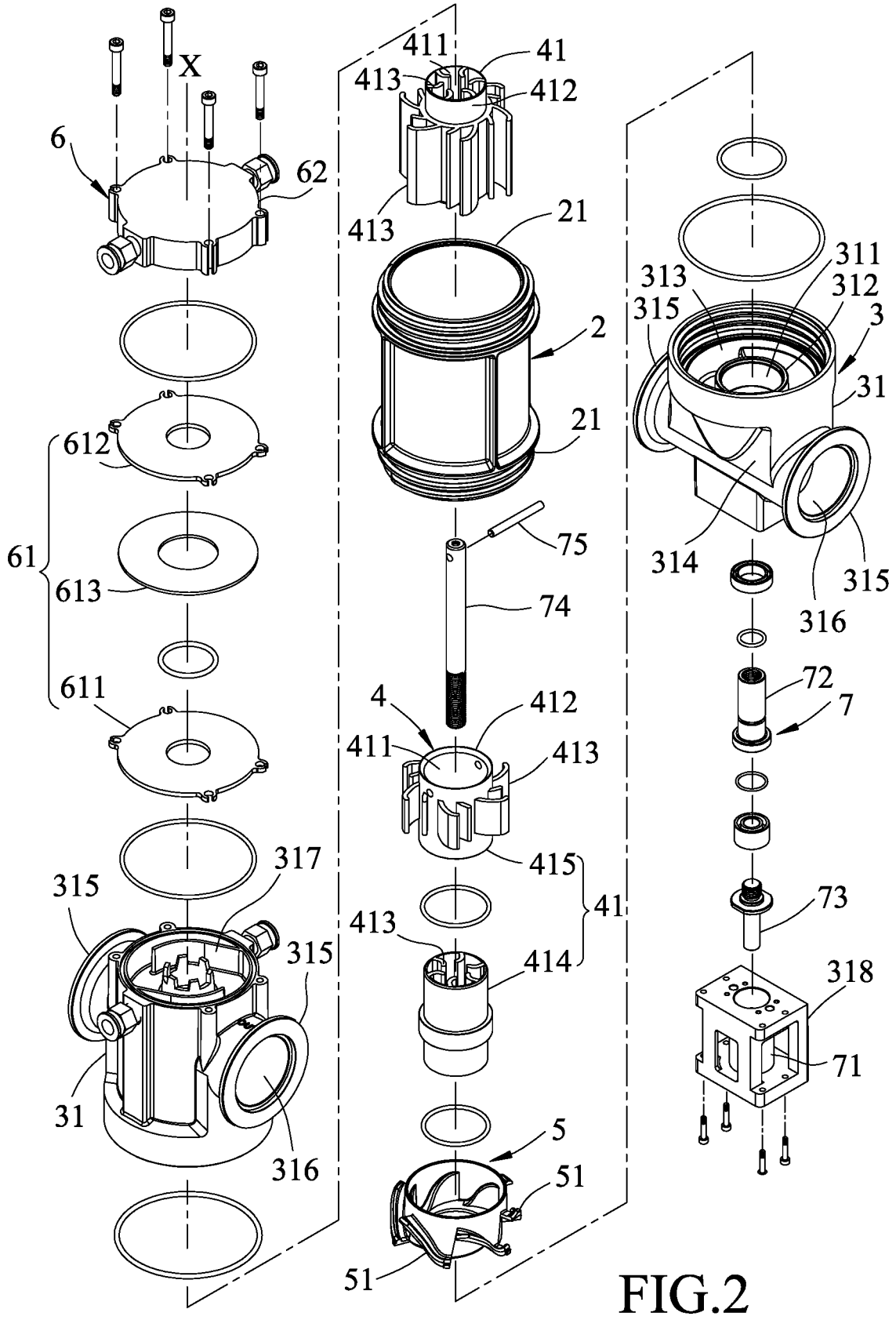
FIG. 2 is an exploded perspective view of a heat exchange device according to an embodiment of the present disclosure.
Figure 3:
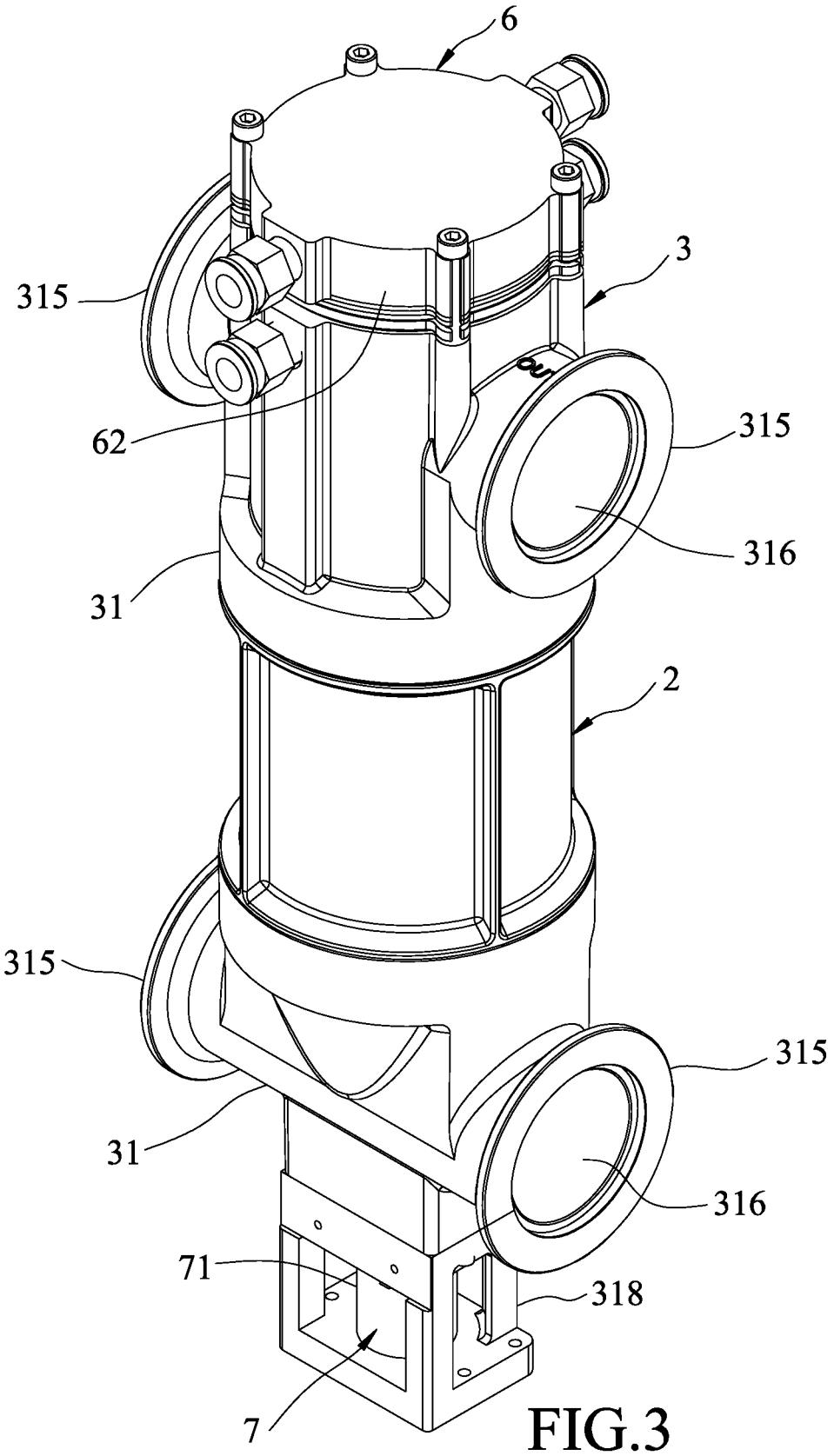
FIG. 3 is a perspective view of the embodiment.
Figure 4:
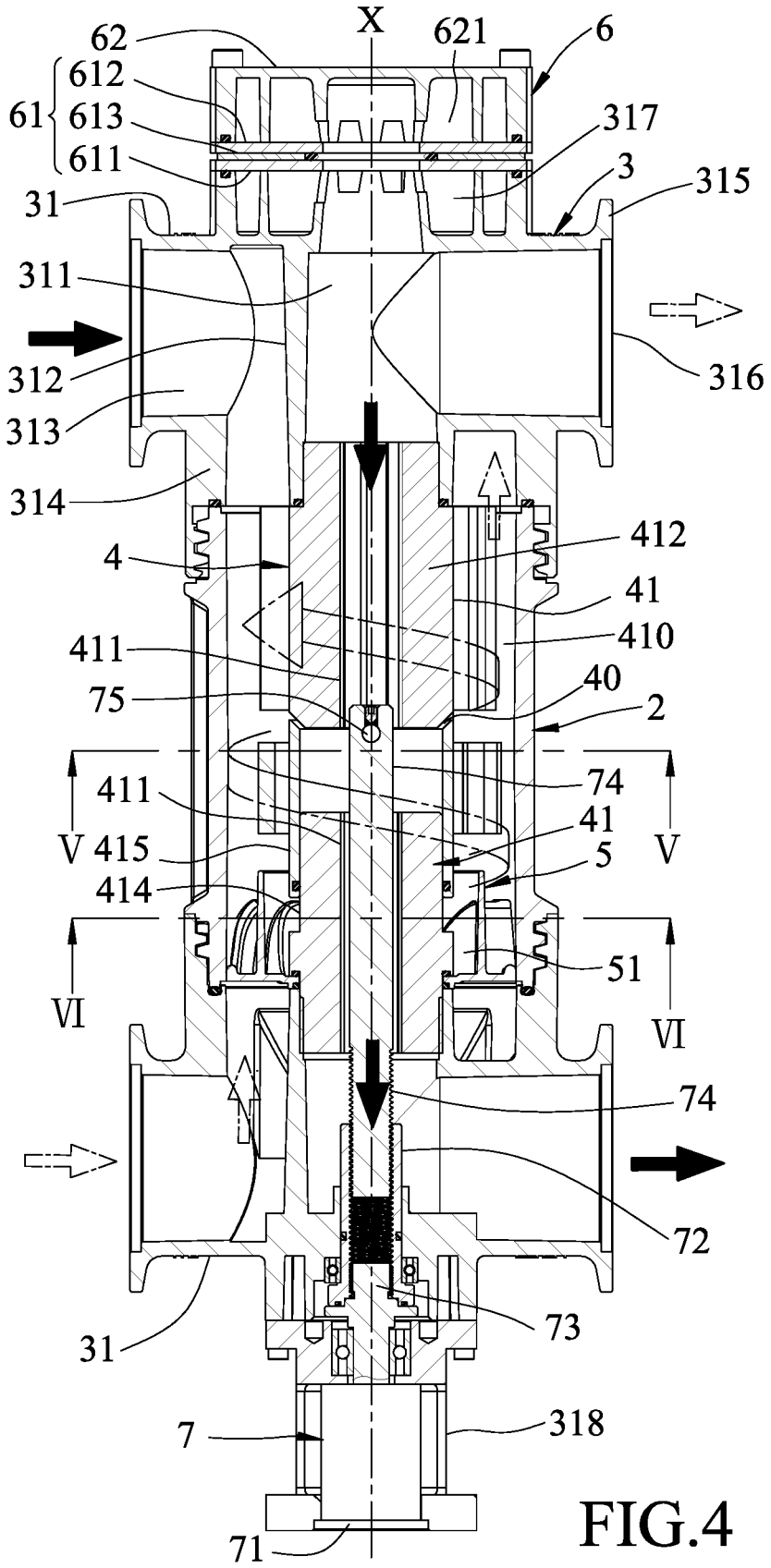
FIG. 4 is a schematic sectional view of the embodiment.

Referring to FIGS. 2 to 4, an embodiment of the heat exchange device according to the present disclosure includes a barrel member 2, a cap unit 3, a heat exchanger 4, an annular vortex generating member 5, a condensing unit 6, and an electric unit 7.

The barrel member 2 includes two end portions 21 opposite along an axis (X).

The cap unit 3 includes two end caps 31 (i.e., upper and lower end caps 31). The end caps 31 are detachably and respectively connected to the end portions 21 of the barrel member 2. Each of the end caps 31 has an inner tube body 312 extending along the axis (X) and defining a tube defined channel 311 therein, and an outer tube body 314 surrounding the inner tube body 312 and cooperating with the inner tube body 312 to define an annular channel 313 therebetween. The outer tube body 314 of each of the end caps 31 has two annular portions 315 spaced apart from each other. In this embodiment, the annular portions 315 of each of the end caps 31 are diametrically opposite to each other and each of the annular portions 315 defines an opening 316. For each of the end caps 31, one of the openings 316 is in fluid communication with the tube defined channel 311, and the other one of the openings 316 is in fluid communication with the annular channel 313. In this embodiment, the tube defined channel 311 is not in fluid communication with the annular channel 313.

It should be noted that the outer tube body 314 of the upper end cap 31 which is connected to the condensing unit 6 defines a heat absorbing path 317 that is in spatial communication with the first flow channel, and that is adapted to permit the fluid to flow therethrough. The cap unit 3 further includes a mounting seat 318 connected to the outer tube body 314 of the lower end cap 31.

Figure 5:
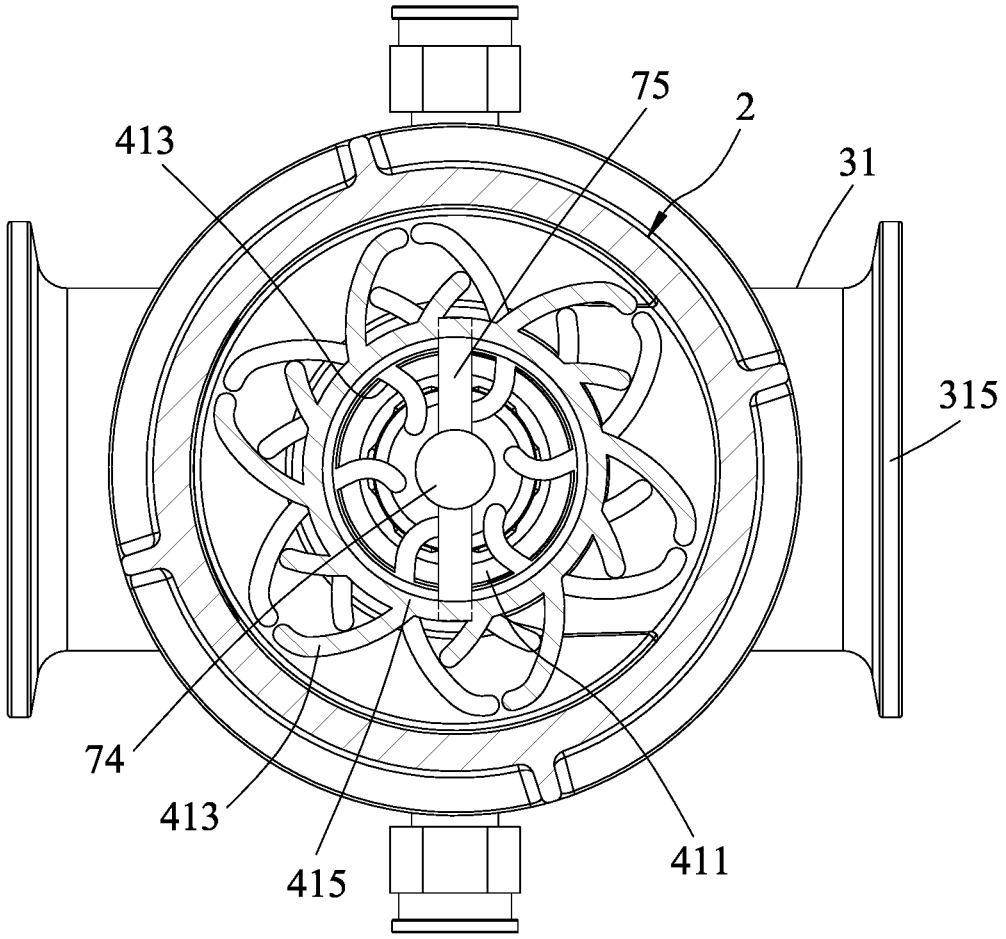
FIG. 5 is a schematic sectional view of the embodiment taken along line V-V in FIG. 4.

Referring to FIGS. 2, 4, and 5, the heat exchanger 4 is disposed in the barrel member 2 between the end caps 31 and includes two conduit members 41 (i.e., upper and lower conduit members 41) spaced apart from each other along the axis (X) by a gap 40. Each of the conduit members 41 is connected telescopically to the inner tube body 312 of a respective one of the end caps 31 and includes a surrounding wall 412 that extends along the axis (X) and that defines a passage 411 therein, and a plurality of fins 413 that extend radially from the surrounding wall 412. The passages 411 of the conduit members 41 cooperate to constitute a passage unit. The surrounding walls 412 of the conduit members 41 cooperate with the barrel 2 to define a vortex chamber 410 therebetween. The passages 411 of the conduit members 41 cooperate with the tube defined channel 311 of each of the end caps 31 and one of the openings 316 of each of the end caps 31 to define a first flow channel adapted to permit the fluid to flow therethrough. The vortex chamber 410 cooperate with the annular channel 313 of each of the end caps 31 and the other one of the openings 316 of each of the end caps 31 to define a second flow channel adapted to permit fluid to flow therethrough.

The fins 413 are adapted to conduct heat exchange with the fluid flowing through the first flow channel and the second flow channel. The surrounding wall 412 of the upper conduit member 41 has inner and outer surfaces radially opposite to each other, and the fins 413 of the upper conduit member 41 are grouped into inner and outer sets that extend respectively and radially from the inner and outer surfaces of the surrounding wall 412. In this embodiment, the lower conduit member 41 includes an inner conduit 414 that is fixed in the barrel 2, and an outer conduit 415 that is sleeved on and movable relative to the inner conduit 414 along the axis (X). The inner conduit 414 has an inner surface and the outer conduit 415 has an outer surface radially opposite to the inner surface of the inner conduit 414. The fins 413 of the lower conduit member 41 are grouped into inner and outer sets that extend respectively and radially from the inner surface of the inner conduit 414 and the outer surface of the outer conduit 415.

Figure 6:
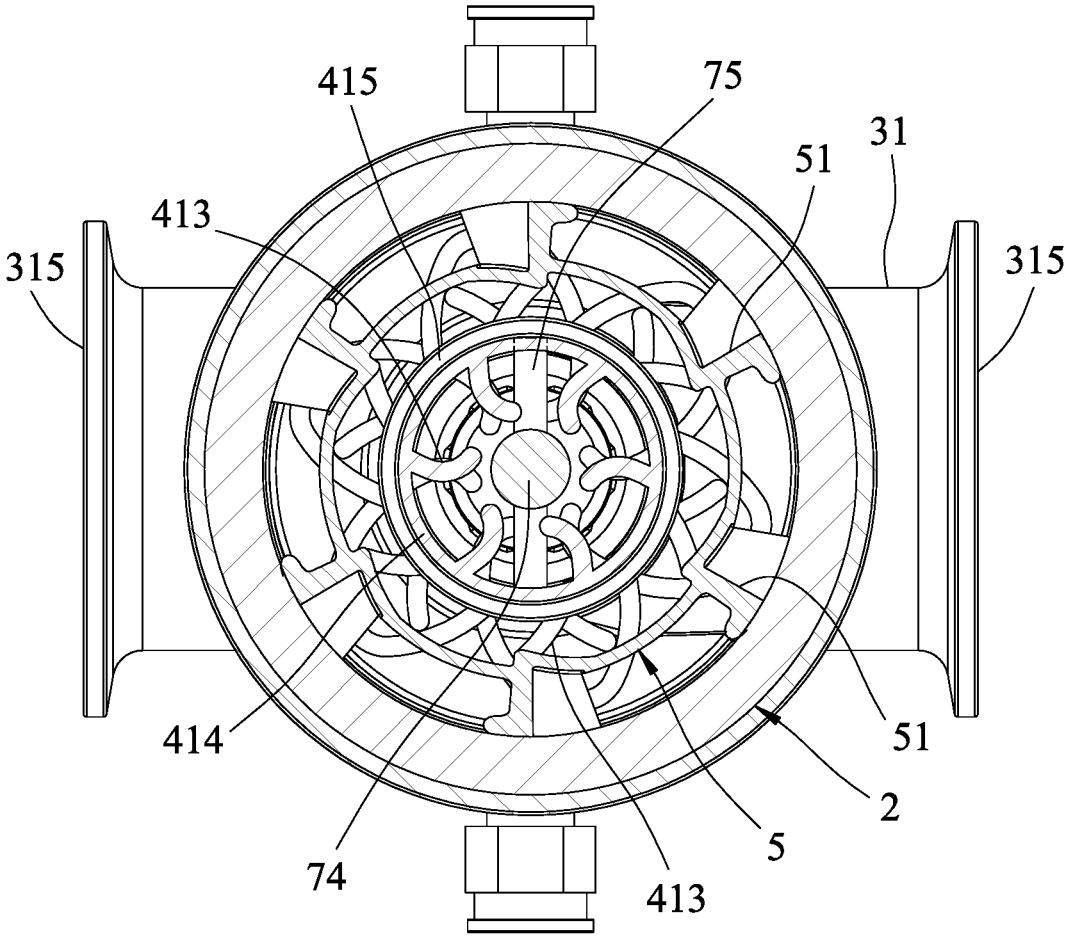
FIG. 6 is a fragmentary schematic sectional view of the embodiment taken along line VI-VI in FIG. 4.

Referring to FIGS. 2, 4, and 6, the annular vortex generating member 5 surrounds the axis (X), is mounted between the barrel 2 and the inner conduit 414 of the lower conduit member 41 of the heat exchanger 4, and includes a plurality of blades 51 that are formed at an outer surface thereof and that are adapted to guide the fluid in the second flow channel to generate a vortex in the second flow channel.

Referring to FIGS. 2 and 4, the condensing unit 6 is mounted to the outer tube body 314 of the upper end cap 31 and includes a cooling chip module 61 and a heat dissipating module 62. The cooling chip module 61 has a heat absorbing plate 611 disposed at an end of the cooling chip module 61 proximate to the upper end cap 31 and adapted for absorbing heat of the fluid, a heat dissipating plate 612 disposed at an end of the cooling chip module 61 distal from the upper end cap 31 along the axis (X) and adapted to dissipate heat absorbed by the heat absorbing plate 611, and a thermoelectric cooling chip 613 being clamped between the heat absorbing plate 611 and the heat dissipating plate 612. The heat dissipating module 62 is in thermal contact with the heat dissipating plate 612, is not in contact with the upper end cap 31, and includes a heat dissipating path 621 that is in fluid communication with the second flow channel and that is adapted to permit the fluid to flow therethrough.

The electric unit 7 is mounted to the lower end cap 31 and includes a motor 71 that is connected to the mounting seat 318, an internal threaded sleeve 72 that is driven by the motor 71 to rotate, a connecting shaft 73 that is rotatably inserted into the mounting seat 318 and that interconnects the internal threaded sleeve 72 and the motor 71 so as to drive the internal threaded sleeve 72 to rotate, and an external threaded shaft 74 that threadedly engages and is driven by the internal threaded sleeve 72 to move along the axis (X) when the internal threaded sleeve 72 is rotated, and that is connected to and co-movable with the outer conduit 415 of the lower conduit member 41 such that a portion of the one of the conduit members 41 is movable relative to the other one of the conduit members 41 along the axis (X) to adjust a dimension of the gap 40 along the axis (X). In this embodiment, the electric unit 7 includes a pin 75 extending into and interconnecting the external threaded shaft 74 and the outer conduit 415.

It is worth noting that the fluid may be liquid, gas, mixtures of liquid and gas, mixtures of liquid and particles, mixtures of gas and particles, or mixtures of particles, liquid and gas. An advantage of employing mixtures of liquid and gas in form of the fluid resides in that a flow velocity of the fluid is relatively high.

In addition, in this embodiment, the barrel member 2, the end caps 31, the conduit members 41, the annular vortex generating member 5, and the heat dissipating module 62 are made of aluminum or other metal materials having a relatively high thermal conductivity, e.g., cooper.

Referring to FIGS. 4 to 6, after the condensing unit 6 is energized, the heat absorbing plate 611 of the cooling chip module 61 absorbs heat of the fluid based on Peltier effect, and the heat dissipating plate 612 dissipates heat absorbed by the heat absorbing plate 611. Since the heat dissipating plate 612 is not in contact with the end cap 31 and the barrel member 2, heat transferred to the end caps 31 can be reduced and deferred. In this embodiment, the heat absorbing path 317 is open toward the heat absorbing plate 611 and is in spatial communication with the first flow channel. In this way, heat of the end caps 31 and the fluid flowing through the heat absorbing paths 317 can be absorbed by the heat absorbing plates 611 of the cooling chip modules 61 to reduce the temperature of the end caps 31. Since the barrel member 2 and the conduit members 41 of the heat exchanger 4 are in thermal contact with the end caps 31, and since the annular vortex generating member 5 is in thermal contact with the conduit members 41 and the barrel member 2, all of the barrel member 2, the heat exchanger 4, and the annular vortex generating member 5 will be cooled down through heat transfer of the heat dissipating modules 62 and the fluid flowing through the heat dissipating paths 621.

In this way, the heat dissipating plates 612 of the cooling chip modules 61 dissipate heat outwardly of the heat exchange devices 6. In this embodiment, the heat dissipated by the heat dissipating plates 612 is absorbed by the fluid flowing through the heat dissipating paths 621 so as to achieve a cooling effect.

As shown in FIG. 4, when the fluid (indicated by the dashed arrows) having a relatively high temperature flows through the second flow channel of the heat exchange device of the present disclosure, it is introduced into the second flow channel through the left lower one of the openings 316, goes past the annular vortex generating member 5 so as to form a vortex in the vortex chambers 410, and then flows around the outer sets of the fins 413 of the heat conduit members 41 extending from the outer surface of the surrounding wall 412 to perform heat exchange. In this way, the fluid with a relatively high temperature can conduct heat exchange with the barrel member 2, the end caps 31, the heat exchanger 4, and the annular vortex generating member 5 so as to achieve the purpose of quick and significant cooling.

When the fluid (indicated by solid arrows shown in FIG. 4) having a relatively high or low temperature flows through the first flow channel of the heat exchange device of the present disclosure, a portion of the fluid will come into contact with the heat absorbing plate 611 of the condensing unit 6, the end caps 31 and the inner sets of the fins 413 respectively formed on the inner surfaces of the surrounding wall 412 and the inner conduit 414. Another portion of the fluid flows into the second flow channel through the gap 40 and discharge through the right upper opening 316 of the upper end cap 31.

As such, the fluid in the second flow channel will perform heat exchange with the heat absorbing plate 611, the end caps 31, and the inner sets of the fins 413 of the heat exchanger 4. In a case that the fluid indicated by the solid arrows has a relatively low temperature, the temperature of the fluid in the second flow channel can be further reduced. On the other hand, in a case that the fluid indicated by the solid arrows has a relatively high temperature, the purpose of cooling can also be achieved. Moreover, it is important to note that the fluids in the first and second flow channels can be mixed by virtue of the vortex so as to adjust the temperature of the fluids, and a flow velocity of the fluid in the first flow channel is increased because of the increased amount of fluid flowing therein, thereby achieving the purpose of quick and significant cooling.

It is worth noting that, since the temperature of the fluid can be significantly reduced by using this embodiment, in a case where the fluid is gas, the majority of the gas will be condensed into liquid so that humidity of the gas can be reduced.

Figure 7:
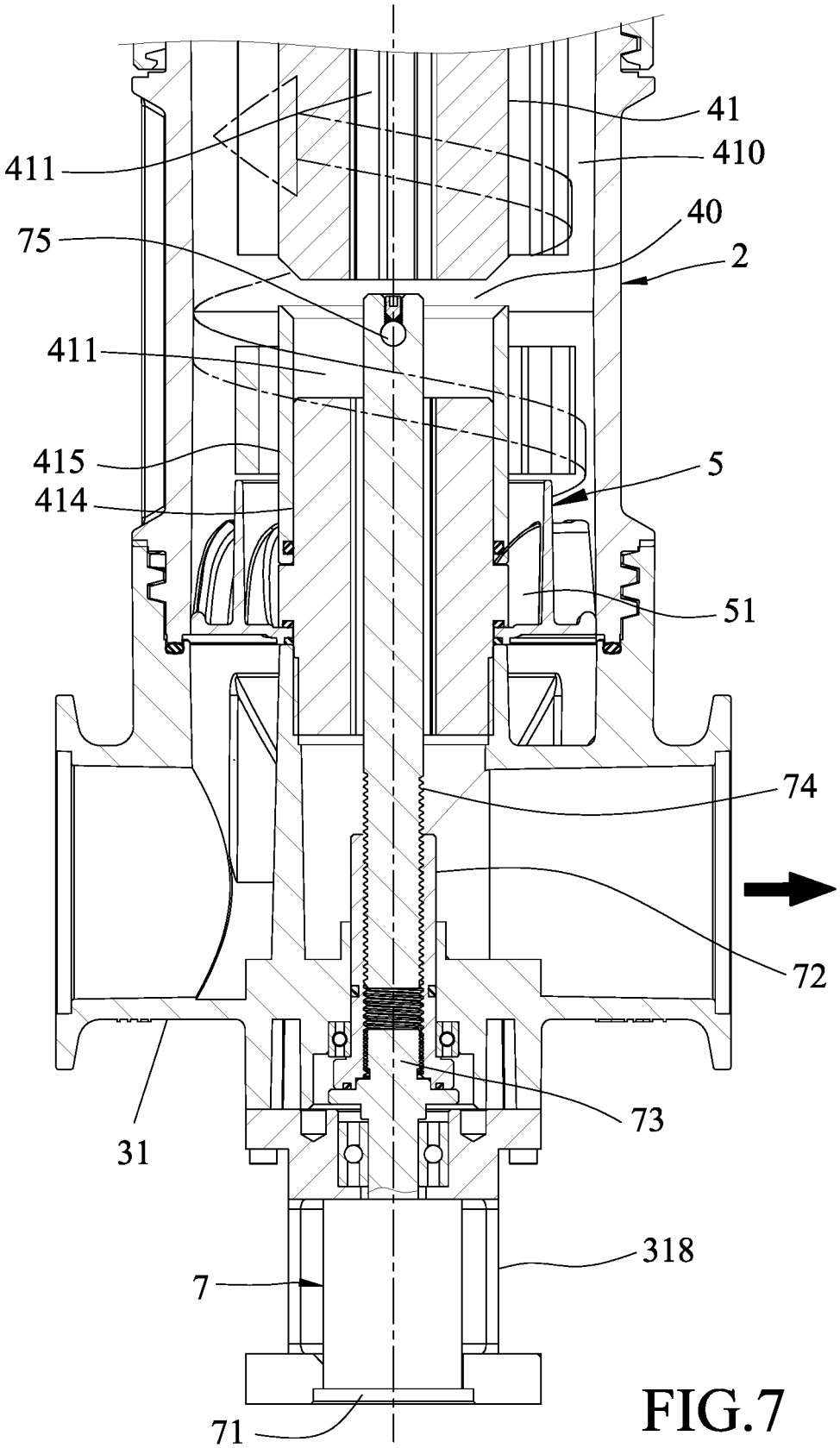
FIG. 7 is a schematic sectional view of the embodiment, illustrating a dimension of a gap between two conduit members of the embodiment being adjusted to be greater than that shown in FIG. 4.

Referring to FIG. 7, when the motor 71 is energized to transmit power to rotate the internal threaded sleeve 72 via the connecting shaft 73, the external threaded shaft 74 threadedly engaging the internal threaded sleeve 72 is driven to move along the axis (X) and is co-movable with the outer conduit 415 of the lower conduit member 41 such that a portion (i.e., the outer conduit 415) of the one of the conduit members 41 is moved relative to the other one of said conduit members 41 along the axis (X) to adjust a dimension of the gap 40 along the axis (X). In this way, the dimension of the gap 40 can be increased and decreased so as to achieve the effect of adjust the velocity and the mixing ratio of the fluids, thereby changing the temperature of the fluid flowing out of the device.

Figure 8:
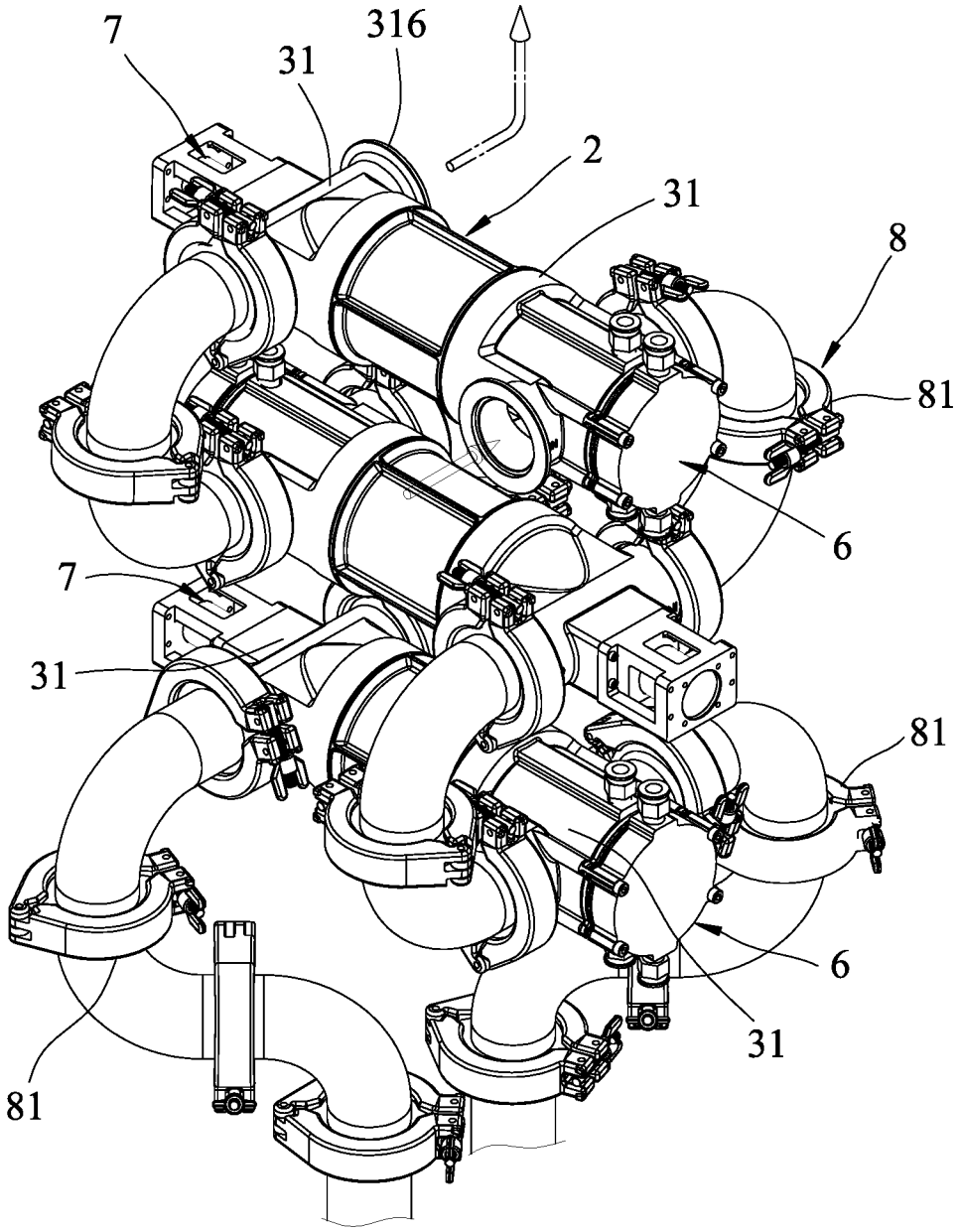
FIG. 8 is a perspective view illustrating a heat exchange system including a plurality of the heat exchange devices of the embodiment being serially connected by a connecting device.
Figure 9:
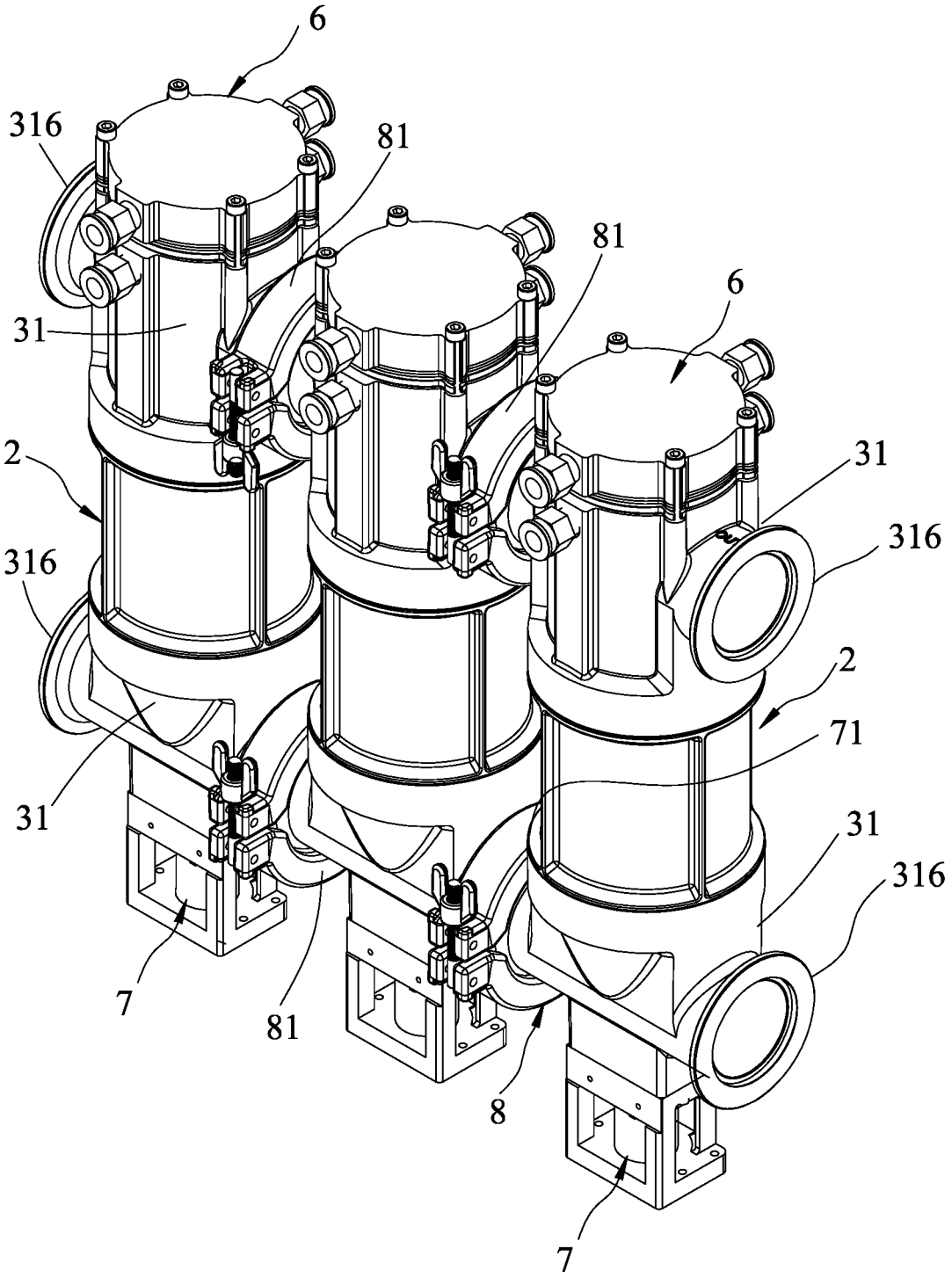
FIG. 9 is a perspective view illustrating another heat exchange system including a plurality of the heat exchange devices of the embodiment being connected in parallel by a connecting device.

FIGS. 8 and 9 illustrate respectively two heat exchange systems each including a plurality of the heat exchange devices of the present disclosure and a connecting device 8.

The connecting device 8 includes a plurality of connecting sets 81. Each of the connecting sets 81 is detachably connected to adjacent two of the heat exchange devices. In the example shown in FIG. 8, each of the connecting sets 81 includes a tube and at least one C-shaped clamp. Note that each of the connecting sets 81 may be modified to include other members that are capable of connecting adjacent two of the heat exchange devices. Since a person having ordinary skill in this art can derive the configuration of the connecting sets 81 from the abovementioned description, further details of the same is omitted and the present disclosure is not limited to the example shown herein.

In this way, during the assembly of the heat exchange system, the heat exchange devices can be connected in series by the connecting sets 81 as depicted in FIG. 8, or connected in parallel by the connecting sets 81 as depicted in FIG. 9, so that the temperature of the fluid flowing through the condensing system can be reduced.

Figure 10:
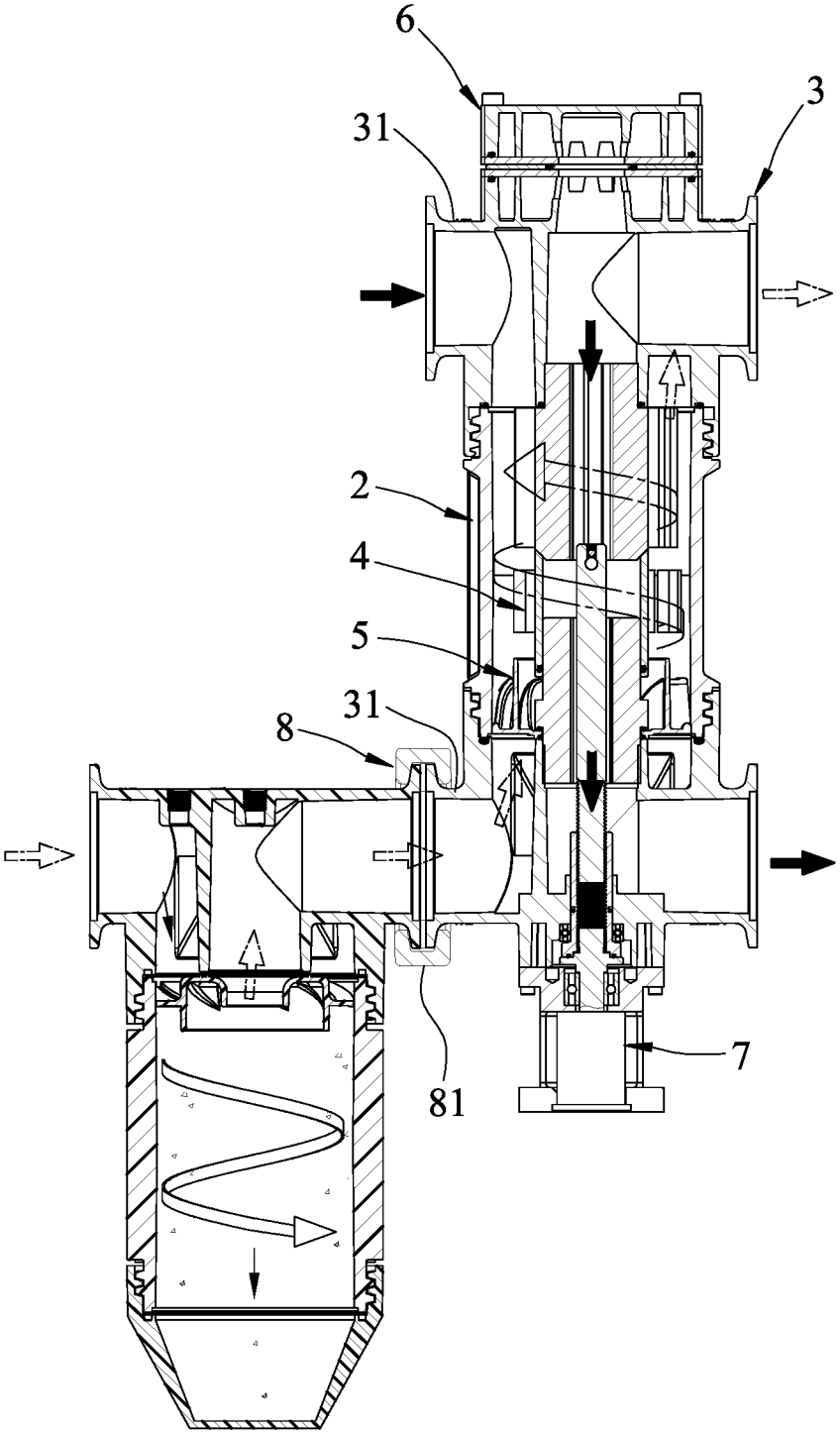
FIG. 10 is a schematic sectional view of the embodiment being connected to a filtration device.
Figure 11:
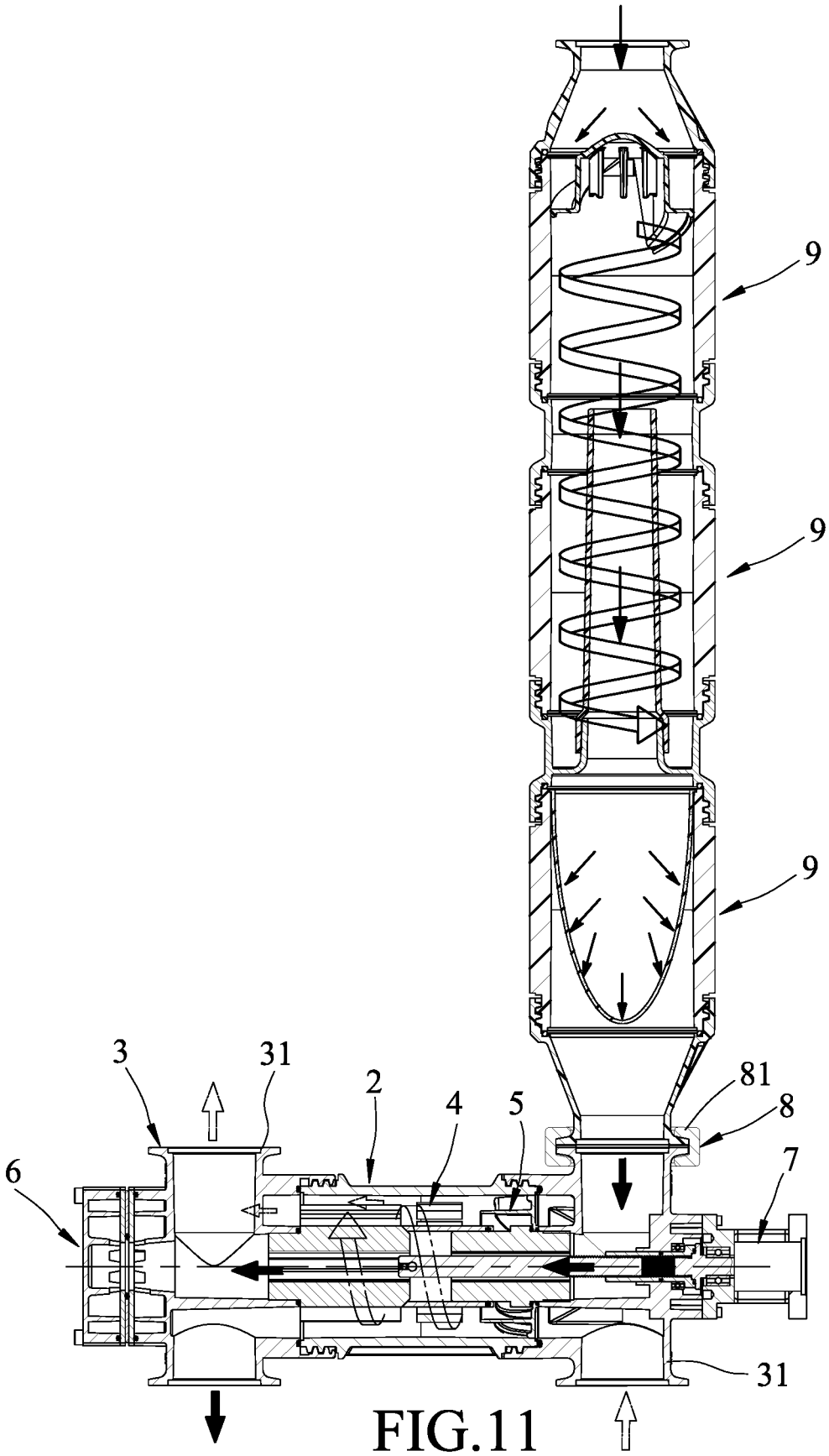
FIG. 11 is a schematic sectional view of the embodiment being connected to a plurality of filtration devices by a connecting device.

It should be noted that the connection among the heat exchange devices and the connecting device 8 of the present disclosure is not limited to the examples shown in FIGS. 8 and 9. FIGS. 10 and 11 illustrate respectively another two heat exchange systems each including at least one filtration device 9 connected to the heat exchange device of the embodiment by the connecting device 8. The filtration device 9 is in fluid communication with the heat exchange device, and is adapted to filter the fluid passing therethrough to capture moisture, oil mist, dust, particles, or a combination thereof in the fluid. The filtration device 9 described above may be a cyclone type separation filter module disclosed in Taiwanese Patent No. 1589344, or a cyclone filtration device disclosed in Taiwanese Patent Publication No. 201912230. Since the main feature of the present disclosure does not reside in the filtration device 9, a person having ordinary skill in the art can derive the configuration of the filtration device 9 from the abovementioned description, and further details of the same is omitted.

Thus, the heat exchange system of the present disclosure can be widely applied in the field of cooling, filtration, or processing, and can be connected to a vacuum machine (not shown) or a mold unit (not shown) if desired. In the case that the heat exchange system is applied in a machining process, e.g., vacuum extrusion, vacuum forging, vacuum casting, or vacuum injection, in addition to reducing of the temperature of the fluid or the mold unit, the heat exchange system of the present disclosure can also condense the fluid in the form of gas into liquid so that dryness and cleanliness of the fluid is enhanced, and thus the quality of products being processed is improved.

Through the above description, the advantages of the embodiment can be summarized as follows:

First, the dimension of the gap 40 can be easily adjusted by the motor 71 using electric power, which is labor-saving, and is easy to use.

Second, by virtue of the design of the condensing unit 6, the heat dissipating plate 612 is not in contact with the end cap 31 and the barrel member 2 and thus quick and significant temperature reduction can be achieved.

Third, the present disclosure can be modularized to be widely applied in the field of cooling, filtration, or machining. Furthermore, the effect of reducing the temperature of the fluid can be achieved, and the cleanliness and dryness of the fluid is enhanced, so that the quality of the products being processed is improved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A heat exchange device comprising:

a barrel including two end portions opposite along an axis;

a cap unit including two end caps detachably and respectively connected to said end portions, each of said end caps having two openings spaced apart from each other;

a heat exchanger disposed in said barrel and between said end caps, and including two conduit members spaced apart from each other along the axis by a gap, each of said conduit members including a surrounding wall that extends along the axis and that defines a passage therein, and a plurality of fins that extend radially from said surrounding wall, said heat exchanger cooperating with said barrel to define a vortex chamber therebetween, said passages of said conduit members cooperating with one of said openings of each of said end caps to define a first flow channel adapted to permit fluid to flow therethrough, said vortex chamber cooperating with the other one of said openings of each of said end caps to define a second flow channel adapted to permit fluid to flow therethrough, said fins being adapted to conduct heat exchange with the fluid flowing through said first flow channel and said second flow channel;

an annular vortex generating member surrounding the axis, mounted between said barrel and said heat exchanger, and including a plurality of blades that are formed at an outer surface thereof and that are adapted to guide the fluid in said second flow channel to generate a vortex;

a condensing unit mounted to one of said end caps of said cap unit and including a cooling chip module that includes a heat absorbing plate disposed at an end of said cooling chip module proximate to the one of said end caps and adapted for absorbing heat of the fluid, and a heat dissipating plate disposed at an end of said cooling chip module distal from the one of said end caps along the axis and adapted to dissipate heat absorbed by said heat absorbing plate; and an electric unit mounted to the other one of said end caps of said cap unit and including a motor, an internal threaded sleeve that is driven by said motor to rotate, and an external threaded shaft that threadedly engages and is driven by said internal threaded sleeve to move along the axis when said internal threaded sleeve is rotated, and that is co-movable with at least a portion of one of said conduit members such that said portion of said one of said conduit members is movable relative to the other one of said conduit members along the axis to adjust a dimension of said gap along the axis.

2. The heat exchange device as claimed in claim 1, wherein each of said end caps further has an inner tube body extending along the axis and defining a tube defined channel therein, and an outer tube body surrounding said inner tube body and cooperating with said inner tube body to define an annular channel therebetween, said tube defined channel cooperating with said passages and one of said openings of each of said end caps to define said first flow channel, said annular channel cooperating with said vortex chambers and the other one of said openings of each of said end caps to define said second flow channel.

3. The heat exchange device as claimed in claim 2, wherein said condensing unit further includes a heat dissipating module in thermal contact with said heat dissipating plate, said heat dissipating module including a heat dissipating path that is in fluid communication with said second flow channel and that is adapted to permit the fluid to flow therethrough.

4. The heat exchange device as claimed in claim 3, wherein said outer tube body of one of said end caps which is connected to said condensing unit defines a heat absorbing path that is open toward said heat absorbing plate, that is in spatial communication with said first flow channel, and that is adapted to permit the fluid to flow therethrough.

5. The heat exchange device as claimed in claim 2, wherein said conduit members are connected telescopically and respectively to said inner tube bodies of said end caps, one of said conduit members including an inner conduit that is fixed in said barrel, and an outer conduit that is connected co-movably to said external threaded shaft and that is sleeved on and movable relative to said inner conduit along the axis.

6. The heat exchange device as claimed in claim 5, wherein said inner conduit of one of said conduit members has an inner surface and said outer conduit has an outer surface radially opposite to said inner surface of said inner conduit, said fins of said inner conduit of one of said conduit members being grouped into two sets that extend respectively and radially from said inner surface of said inner conduit and said outer surface of said outer conduit.

7. The heat exchange device as claimed in claim 2, wherein one of said end caps, which permits said electric unit to mounted thereto, further includes a mounting seat connected to said outer tube body of a corresponding one of said one of said end caps, said motor being connected to said mounting seat, said electric unit further including a connecting shaft that is rotatably inserted into said mounting seat and that interconnects said internal threaded sleeve and said motor so as to drive said internal threaded sleeve to rotate.

8. The heat exchange device as claimed in claim 1, wherein said surrounding wall of one of said conduit members has inner and outer surfaces radially opposite to each other, and said fins are grouped into two sets that extend respectively and radially from said inner and outer surfaces of said surrounding wall.

9. The heat exchange device as claimed in claim 1, wherein said barrel, said end caps, said heat exchanger, and said annular vortex generating member are made of metal materials.

10. A heat exchange system comprising:

a plurality of heat exchange devices, each of said heat exchange devices including a barrel including two end portions opposite along an axis, a cap unit including two end caps detachably and respectively connected to said end portions, each of said end caps having two openings spaced apart from each other, a heat exchanger disposed in said barrel and between said end caps, and including two conduit members spaced apart from each other along the axis by a gap, each of said conduit members including a surrounding wall that extends along the axis and that defines a passage therein, and a plurality of fins that extend radially from said surrounding wall, said heat exchanger cooperating with said barrel to define a vortex chamber therebetween, said passages of said conduit members cooperating with one of said openings of each of said end caps to define a first flow channel adapted to permit fluid to flow therethrough, said vortex chamber cooperating with the other one of said openings of each of said end caps to define a second flow channel adapted to permit fluid to flow therethrough, said fins being adapted to conduct heat exchange with the fluid flowing through said first flow channel and said second flow channel, an annular vortex generating member surrounding the axis, mounted between said barrel and said heat exchanger, and including a plurality of blades that are formed at an outer surface thereof and that are adapted to guide the fluid in said second flow channel to generate a vortex;

a condensing unit mounted to one of said end caps of said cap unit and including a cooling chip module that includes a heat absorbing plate disposed at an end of said cooling chip module proximate to the one of said end caps and adapted for absorbing heat of the fluid, and a heat dissipating plate disposed at an end of said cooling chip module distal from the one of said end caps along the axis and adapted to dissipate heat absorbed by said heat absorbing plate, and an electric unit mounted to the other one of said end caps of said cap unit and including a motor, an internal threaded sleeve that is driven by said motor to rotate, and an external threaded shaft that threadedly engages and is driven by said internal threaded sleeve to move along the axis when said internal threaded sleeve is rotated, and that is co-movable with at least a portion of one of said conduit members such that said portion of said one of said conduit members is movable relative to the other one of said conduit members along the axis to adjust a dimension of said gap along the axis; and a connecting device including a plurality of connecting sets, each of said connecting sets being detachably connected to adjacent two of said heat exchange devices.

11. A heat exchange system comprising:

at least one heat exchange device including a barrel including two end portions opposite along an axis, a cap unit including two end caps detachably and respectively connected to said end portions, each of said end caps having two openings spaced apart from each other, a heat exchanger disposed in said barrel and between said end caps, and including two conduit members spaced apart from each other along the axis by a gap, each of said conduit members including a surrounding wall that extends along the axis and that defines a passage therein, and a plurality of fins that extend radially from said surrounding wall, said heat exchanger cooperating with said barrel to define a vortex chamber therebetween, said passages of said conduit members cooperating with one of said openings of each of said end caps to define a first flow channel adapted to permit fluid to flow therethrough, said vortex chamber cooperating with the other one of said openings of each of said end caps to define a second flow channel adapted to permit fluid to flow therethrough, said fins being adapted to conduct heat exchange with the fluid flowing through said first flow channel and said second flow channel, an annular vortex generating member surrounding the axis, mounted between said barrel and said heat exchanger, and including a plurality of blades that are formed at an outer surface thereof and that are adapted to guide the fluid in said second flow channel to generate a vortex;

a condensing unit mounted to one of said end caps of said cap unit and including a cooling chip module that includes a heat absorbing plate disposed at an end of said cooling chip module proximate to the one of said end caps and adapted for absorbing heat of the fluid, and a heat dissipating plate disposed at an end of said cooling chip module distal from the one of said end caps along the axis and adapted to dissipate heat absorbed by said heat absorbing plate, and an electric unit mounted to the other one of said end caps of said cap unit and including a motor, an internal threaded sleeve that is driven by said motor to rotate, and an external threaded shaft that threadedly engages and is driven by said internal threaded sleeve to move along the axis when said internal threaded sleeve is rotated, and that is co-movable with at least a portion of one of said conduit members such that said portion of said one of said conduit members is movable relative to the other one of said conduit members along the axis to adjust a dimension of said gap along the axis;

at least one filtration device connected to and in fluid communication with said heat exchange device and adapted to filter the fluid passing therethrough to capture moisture, oil mist, dust, particles, and a combination thereof in the fluid; and a connecting device including at least one connecting set detachably connected between said at least one heat exchange device and said at least one filtration device.

* * * * *